US005564560A

United States Patent [19]

Minelli et al.

[11] Patent Number: 5,564,560

[45] Date of Patent: Oct. 15, 1996

[54] DUAL FUNCTION BUTTON

[75] Inventors: Jeffrey D. Minelli, Lenexa; Jonathan C. Burrell; Sheldon T. Wheaton, both of Olathe, all of Kans.

[73] Assignee: Garmin Corporation, Lenexa, Kans.

[21] Appl. No.: 479,181

[22] Filed: Jun. 7, 1995

[51] Int. Cl.[6] ..... H01H 1/10

[52] U.S. Cl. ..... 200/516; 200/519; 200/5 R; 200/512; 200/1 B

[58] Field of Search ..... 200/516, 519, 200/520, 5 R, 521, 537, 538, 540, 5 A, 512, 1 B, 18

[56] References Cited

U.S. PATENT DOCUMENTS

| | | | |
|---|---|---|---|
| 4,527,030 | 7/1985 | Oelsch | 200/5 A |
| 4,540,865 | 9/1985 | Calder | 200/5 A |
| 4,659,881 | 4/1987 | Dowe | 200/516 |
| 4,668,843 | 5/1987 | Watanabe | 200/5 A |

*Primary Examiner*—David J. Walczak

*Attorney, Agent, or Firm*—Kokjer, Kircher, Bowman & Johnson

[57] ABSTRACT

A dual function button for keyboards and keypads. The button includes a first contact switch which is activated by a first manual pressure. The first contact switch is preferably formed by a resilient cover having a conductive pellet on its interior face, and a flexible substrate having spaced contacts below the pellet. The first manual pressure causes the pellet to impinge upon the spaced contacts, completing a first circuit. The button also includes a second contact switch which is activated by a second, greater, manual pressure. The second contact switch includes the resilient cover of the first switch, a rigid substrate mounting spaced contacts, and a flexible conductive dome mounted on the rigid substrate below the resilient cover. The second manual pressure will cause the dome to resiliently deform and impinge upon the contacts, closing a second circuit. In this manner two functions may be provided by a single switch. The two functions may advantageously be a dual-speed cursor control.

12 Claims, 1 Drawing Sheet

DUAL FUNCTION BUTTON

BACKGROUND OF THE INVENTION

1. Field of the Invention

The present invention relates in general to buttons for use with electronic devices. In particular, the present invention relates to an improved button providing two states or functions.

2. Description of the Related Art

In electronic devices it is common to provide a keyboard having one or more keys or buttons, as are commonly found on computer keyboards or calculator keypads. To reduce the size and complexity of such keyboards and keypads, it has been known to employ a single button or key for two or more functions.

This has typically been achieved by using the particular key in conjunction with one or more other keys. For example, contemporary computer keyboards are typically provided with numerous alphanumeric keys, and with special keys identified as ALTERNATE and/or CONTROL keys. Pressing the ALTERNATE and/or CONTROL key in conjunction with one of the alphanumeric keys will produce a result which is different from pressing the alphanumeric key alone.

Similarly, calculator keypads are often provided with a SECOND key in addition to the numeric and function keys. Pressing the SECOND key followed by a numeric or function key will produce a different result than simply pressing the numeric or function key alone.

While these arrangements clearly provide increased possibilities for a given number of keys, there are drawbacks. In particular, the user must depress two or more keys at the same time, which often requires the use, of both hands. This is clearly not preferred in many applications where the device having the keyboard is used during another operation, such as a navigational computer used during the piloting of a watercraft or aircraft. The SECOND key approach eliminates the need for two-handed use, but still requires that the user identify and press two keys to obtain the desired function. The time required for this is time spent away from other tasks, such as piloting.

SUMMARY OF THE INVENTION

An object of the present invention is to provide a button or key which provides dual functions.

Another object of the present invention is to provide such a button or key which provides dual functions without influence from other actions, such as pressing a further key.

Yet another object of the present invention is to provide such a button or key which may be placed in one of three positions corresponding to rest or no function, first function, and second function.

A further object of the present invention is to provide such a button or key in which the first function and second function positions are achieved by simple pressing of the button.

Yet another object of the present invention is to provide such a button or key in which the first function is provided by pressing upon the button with a first pressure to move the button to the first function position, and the second function is provided by increasing the pressure to a second pressure to move the button to the second function position.

These and other objects are achieved by a dual function button for keyboards and keypads. The button includes a first contact switch which is activated by a first manual pressure. The first contact switch is preferably formed by a resilient cover having a conductive pellet on its interior face, and a flexible substrate having spaced contacts below the pellet. The first manual pressure causes the pellet to impinge upon the spaced contacts, completing a first circuit. The button also includes a second contact switch which is activated by a second, greater, manual pressure. The second contact switch includes the resilient cover of the first switch, a rigid substrate mounting spaced contacts, and a flexible conductive dome mounted on the rigid substrate below the resilient cover. The second manual pressure will cause the dome to resiliently deform and impinge upon the contacts, closing a second circuit. In this manner two functions may be provided by a single switch. The two functions may advantageously be a dual-speed cursor control.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
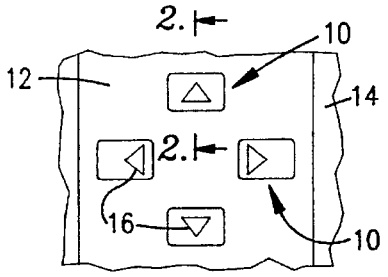
FIG. 1 is a top view of a set of buttons according to the present invention.

With reference to FIG. 1, a plurality of buttons according to the present invention are designated by reference numeral 10. Each of the buttons 10 forms a portion of a keypad 12 of an electronic device 14. The device 14 may of course take many forms, such as a calculator, a keyboard, etc. Each of the buttons 10 will preferably extend outward from the keypad in a known manner, but may be flush with the keypad if desired. Each button 10 will typically have indicia 16 on or near the button. In the embodiment shown, the indicia consists of an arrowhead such as for designating cursor or display movement.

Figure 2:
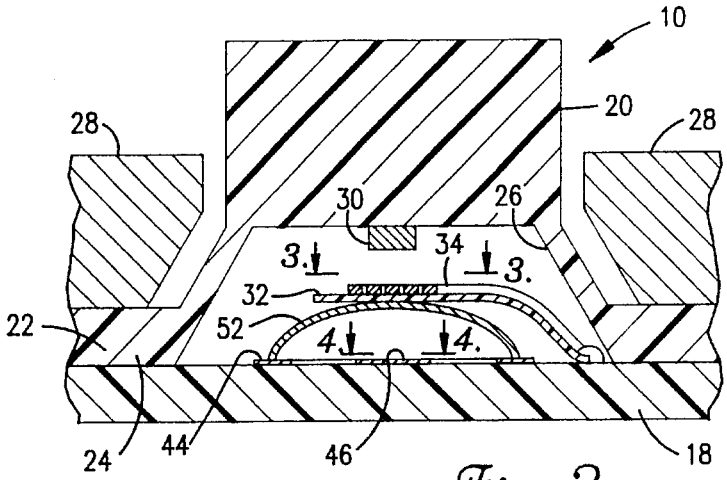
FIG. 2 is a cross-sectional side view along line 2—2 of FIG. 1.

With reference to FIG. 2, the button 10 is shown to include a rigid substrate 18. The substrate 18 preferably consists of a printed circuit board. Mounted above or to the exterior of the substrate 18 is a cap 20. It is movement of this cap 20 which results in operation of the button 10. As indicated above, the cap 20 may take various forms. The cap may be a rigid member similar to standard keys on full-sized keyboards, or may be a flexible membrane, with appropriate standard mountings as are known in the art.

In the preferred embodiment, the cap 20 is formed of an elastic material, yet has a sufficient thickness that the cap itself is not particularly flexible. The cap, however, is but a section of a monolithic keypad membrane 22. The membrane 22 includes a main body 24 which extends between each of the keys 10, and outward toward the periphery of the keypad 12, and in this embodiment is substantially planar. The main body has a thickness which permits substantial flexibility, but this is not required. As noted, each of the caps 20 is of a relatively substantial thickness, and thus typically protrude from the main body. Additionally, each of the caps 20 is connected to the main body by an intermediate section 26.

As is best shown in FIG. 2, the intermediate section 26 consists of a reduced thickness area extending from the upper face of the main body to the lower peripheral edge of the cap 20. This reduced thickness is such that the intermediate section is quite flexible. Of most importance, however, is that the intermediate section forms a collapsible hollow column. Specifically, when the user applies pressure to the cap 20, the intermediate section will initially resist this pressure with minimal deformation. However, when a sufficient first pressure is attained, the column formed by the intermediate portion will buckle and the cap will move downward quickly and easily. While the intermediate section could be formed as a tubular cylinder, it is preferred to have the column taper outward toward its bottom, as shown in FIG. 2.

The use of the buckling column configuration for the intermediate section provides a clearly identified tactile sensation for button movement similar to a "click". The resilient nature of the column causes it to assume its original configuration upon removal of the manual pressure. Various other arrangements could of course also be used to permit the movement of the cap, consistent with prior art practices.

The device 14 may also include a keypad cover 28 mounted above (or exterior to) the main body 24, with the cover including apertures through which the caps 20 extend. Such a cover may serve to protect the main body and/or provide improved aesthetics. Additionally, the resilient nature of the membrane 22 permits the main body 24 and cover 28 to seal together to provide liquid and gas seal integrity in the keypad area.

From the above description, motion of the cap 20 toward the substrate 18 should be clear. The structure and operation of the first switch will now be described.

With reference to FIG. 2, it will be seen that an interior face of the cap 20, in spaced opposed relation to the substrate 18, mounts an electrically conductive pellet 30. Additionally, the substrate 18 mounts a flexible circuit film 32. As should be clear from this usage, the term "mounts" (as well as "supports" and similar terms) as used herein is intended to include arrangements where a first element is not directly mounted to a second element, but is supported by the second element via intermediate elements.

Figure 3:
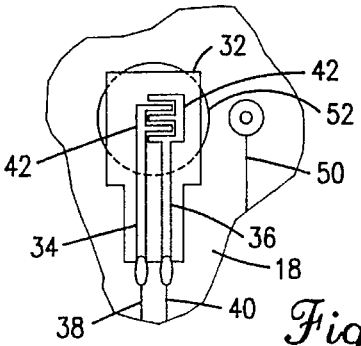
FIG. 3 is a plan view along line 3—3 of FIG. 2.

As is best shown in FIG. 3, the upper or exterior face of the film 32 includes a first pair of conductive traces 34 and 36. The traces begin at a point adjacent the peripheral edge of the film 32, where they are connected to a first pair of PCB traces 38 and 40 via solder or other suitable electrical connection. The PCB traces 38 and 40 will in turn be connected to a source of power and to an integrated circuit (not shown), as is known in the art for electronic devices. Each of the first traces 34 and 36 includes a free end having a fork pattern 42 having one or more tines. The tines from each pattern 42 are in spaced interlocking arrangement. As such, at this point the traces are not in contact and there is no circuit formed.

Figure 5:
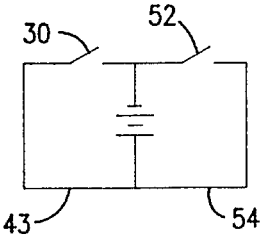
FIG. 5 is a circuit diagram of the button of FIG. 2.

Upon application of the first pressure, the cap 20 will move downward or toward the substrate 18. This movement will cause the conductive pellet 30 to come into contact with the first traces 34 and 36. Specifically, the conductive pellet has a sufficient size, and is properly placed on the cap 20, such that the pellet will overlay the fork patterns 42 when the cap 20 is moved downward under the first pressure. This results in electrical contact between the first traces 34 and 36, completing a first circuit 43 (FIG. 5). Completion of the first circuit is typically sensed (preferably from trace 40) by the integrated circuit (not shown), to cause a first hardware or software controlled function.

From the above description, it is clear that application of the first pressure to the button results in a first state of the button (i.e. completion of a first switch), which will be used to activate a first function of the device by first switch means including the traces 34 and 36, the pellet 30 and the movable cap 20. Additionally, this first switch means is activated by application of the first pressure and upon movement of the cap to a first position.

The structure and operation of the second switch will now be described.

Figure 4:
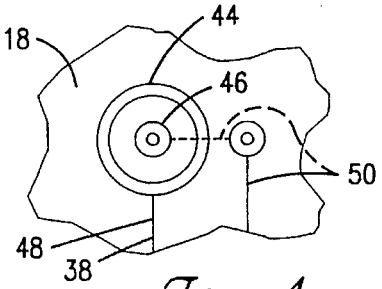
FIG. 4 is a plan view along line 4—4 of FIG. 2.

With reference to FIG. 4 it is seen that the substrate 18 mounts a pair of concentric second trace patterns 44 and 46. The second traces are connected to a second pair of PCB traces 48 and 50. Due to the concentric nature of the traces 44 and 46, the interior trace 46 may require connection via another layer of the PCB substrate, such as the opposite face of the PCB as is shown. As with the first PCB traces, the second PCB traces 48 and 50 will in turn be connected to a source of power and to an integrated circuit (not shown), as is known in the art for electronic devices. In the preferred form, the input power PCB trace may be common between the PCB traces, such that the PCB trace 48 may simply be a continuation of the PCB trace 38. Such an arrangement will reduce the number of traces necessary on the PCB 18.

With reference to FIG. 2, mounted upon the second trace 44 is a resiliently collapsible, electrically conductive dome 52, as are known in the art, with the dome being secured in a known manner. Additionally, the dome and its associated second traces are located beneath the cap 20. In this regard it is noted that the film 32 is placed intermediate the upper or exterior (i.e. convex) face of the dome and the cap 20. The solder connection between the film and the substrate is sufficient to maintain the film in this position, and no connection between the film and dome is required. It is also noted that the film 32 serves to insulate the conductive dome 52 from the first traces 34 and 36.

As may be envisioned, and as is shown in FIG. 2, the dome in its normal state does not contact the second trace 46, such that no circuit is formed and the second switch is open. Upon application of pressure to the dome, it will collapse, and contact the second trace 46, thus creating a second circuit 54 (FIG. 5). The pressure required to cause this collapse of the dome is set (via the physical properties of the dome) to be a second pressure greater than the first pressure.

Therefore, upon application of the first pressure to the cap 20, the cap will move downward to press the pellet 30 against the film and first traces to complete the first circuit 43. No further movement will occur at this point, as the dome will resist this first pressure. However, if the manual pressure on the cap is increased to the second pressure, the dome 52 will collapse, completing the second circuit 54. Completion of the second circuit is typically sensed (preferably from trace 50) by the integrated circuit (not shown), to cause a second hardware or software controlled function. As such, application of the second pressure to the button results in a second function of the device.

As with the first function, application of the second pressure to the button results in a second state of the button (i.e. closing of a second switch), which will be used to activate a second function of the device. As such, the button includes second switch means which includes the substrate 18, the traces 44 and 46, the dome 52 and the movable cap 20. Additionally, this second switch means is activated by application of the second pressure and upon movement of the cap to a second position.

Due to the resilient nature of the dome, reducing the manual pressure below the second pressure will cause the dome to move to its original configuration, breaking the second circuit. As with the first switch, this movement of the dome produces a distinct tactile sensation similar to a "click".

It is noted that the first circuit 43 will always be completed prior to the second circuit 54, and will always be complete when the second circuit is completed. This is of course due to the first pressure inherently being applied during application of the greater second pressure. It is also noted that a reduction in manual pressure from the second to the first will result in breaking the second circuit, but will continue to complete the first circuit. The user may thus easily switch between the first and second functions simply by varying the amount of pressure applied.

As noted, this operation sequence results in the button 10 causing a signal for the first function before and after each signal for the second function, due to the relative slowness of human movement. Where the first and second functions are disparate, such as causing a numeral to be displayed or calculating a square root of the number currently displayed, this operational sequence must be modified. For example, the first function would be controlled such that it would not operate until a set time period had elapsed.

Figure 6:
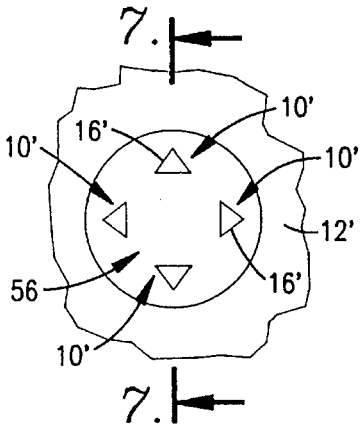
FIG. 6 is a top view of a second embodiment of a button set according to the present invention.
Figure 7:
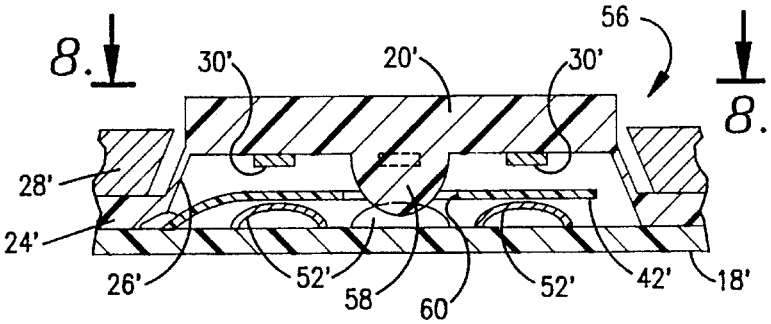
FIG. 7 is a cross-sectional side view along line 7—7 of FIG. 6.
Figure 8:
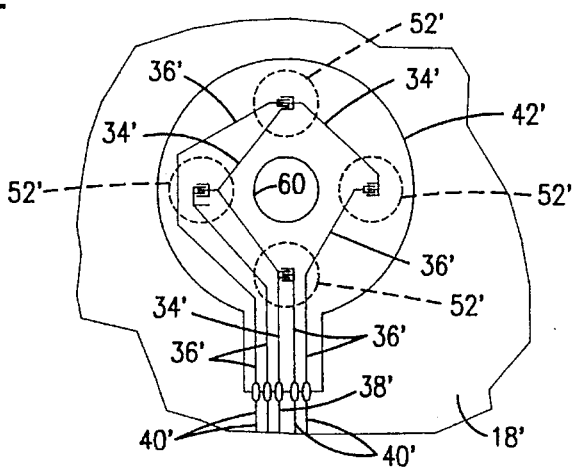
FIG. 8 is a plan view along line 8—8 of FIG. 7.

There are other applications, however, where this operational sequence is acceptable. For example, and as illustrated in the drawings, the buttons of the present invention could be used for cursor or display movement control. For this use, the first switch would move the cursor (or the entire screen displayed) in the appropriate direction at a first speed. The second switch would then move the cursor (or display) in that same direction but at a second, higher speed. This would allow the user to begin cursor movement at the low speed, then upon determining mentally that greater speed was required, to move the cursor at the higher speed. Once the cursor approaches the desired position, the user could reduce the cursor speed for fine adjustment to the final desired position. Other uses, such as for zoom control are also possible.

Where buttons according to the present invention are to be used for cursor or display movement control (or like functions), modification may be made as shown in the second embodiment of FIGS. 6–8, where like elements are designated by primed numerals.

With reference to FIG. 6, it is seen that a plurality of the buttons 10' according to the present invention are located in a single cursor control pad 56. The pad will be part of a keypad 12' and will include indicia 16' associated with each button 10'. As before, the indicia takes the form of directional arrows for the illustrated example of cursor control.

With reference to FIG. 7, it is seen that the structure of the pad 56 is similar to that of the first embodiment, though certain elements are multiplied. For example, there are several (in this case four) of the domes 52', each having associated second traces (not shown) on the substrate 18'. There are also a like number of the first traces 34' and 36' (FIG. 8). While individual films 32' could be used for each set of first traces, it is more economical to employ a single film 42', as is shown.

The use of the single film also permits the sharing of the power trace. As is shown in FIG. 8, the trace 34' is common to all four buttons. A similar arrangement may be used for the second traces (not shown but corresponding to element 48). For further sharing, the power trace for both the first and second traces may connect to the same PCB trace 38'.

The cap 20' is not multiplied, but is common to all of the buttons 10'. As in the first embodiment, the cap is part of the monolithic main body 24' and includes the buckling intermediate section 26', although other cap arrangements could be employed. As may be envisioned, pressure applied to the common cap 20', without more, could result in activation of all of the first switches.

To prevent this, the cap 20' is provided with a rocker pin 58 extending downward (or inward) from its lower (or interior) face. This rocker pin is preferably a monolithic portion of the cap, has a similar relatively rigid thickness, and is located radially interior of the various buttons 10'. In particular, for the arrangement shown, the pin 58 is centrally located on the cap 20', while each of the buttons 10' is located near a radial edge.

Additionally, the rocker pin has a height (toward the substrate 18') such that the distance from the free end of the pin 58 to the substrate 18' is less than the distance between the first 20 traces 34' and 36' and the pellets 30'. To accommodate this, the film(s) 32'/Δ must permit passage of the pin. As is best shown in FIG. 8, this may be accomplished by providing a hole 60 in the film 42' at the position of the pin 58.

With this arrangement, the relatively rigid cap 20' will tend to pivot upon the pin 58 when pressure is applied at any of those radial points. For example, applying manual pressure upon the uppermost indicia 16 in FIG. 6 would cause the cap 20' to move downward upon reaching the first pressure. After a small amount of this downward movement (or none if desired), the free end of the rocker pin 58 will engage against the substrate 18'. Continued application of the first pressure will cause the relatively rigid cap 20' to pivot toward the uppermost button 10'. As such, only that one button would be activated, with no contact between the pellets and first traces of the other buttons. Similar results are achieved for the second pressure.

The operation of the second embodiment is similar to that of the first, with the only difference being that a single cap 20' is pressed, albeit at different locations, to activate the differing buttons.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A dual function button, comprising:

a substrate;

a cap mounted to said substrate and movable between a rest position, a first position, and a second position, movement of said cap between said positions being generally normal to said substrate;

a first switch mounted intermediate said cap and said substrate, said first switch being open when said cap is in said rest position and being closed when said cap is in said first position, wherein said first switch includes:

a film mounted in spaced relation to said cap when said cap is in said rest position;

a first pair of traces mounted on said film in opposed relation to said cap; and a conductive pellet mounted to said cap in opposed relation to said first traces, said pellet being placed such that said pellet contacts both said first traces when said cap is in said first position; and a second switch mounted intermediate said first switch and said substrate, said second switch being open when said cap is in said rest and said first positions, and being closed when said cap is in said second position, wherein said second switch includes:

a pair of second traces mounted on said substrate in opposed relation to said cap; and a resiliently deformable dome mounted upon said substrate, and in opposed relation to said cap, in a position such that in an underformed condition said dome does not contact both said second traces but in a deformed condition said dome contacts both said second traces, said dome being positioned and sized such that said dome is in said undeformed condition when said cap is in said rest and said first positions, but said dome is in said deformed condition when said cap is in said second position.

2. A button as in claim 1, wherein said cap includes a resilient peripheral intermediate section forming a column extending toward and supported by said substrate, said column maintaining said cap in said rest position upon application of pressure below a first pressure, and buckling upon application of pressure to said cap of at least said first pressure.

3. A button as in claim 2, wherein said dome moves from said undeformed condition to said deformed condition upon application of a second pressure, said second pressure being higher than said first pressure.

4. A button as in claim 3, further comprising a plurality of sets of said first and said second switches, each associated with said cap.

5. A button as in claim 4, wherein said cap includes a rocker pin mounted thereon and projecting toward a free end in opposed relation to said substrate, said pin being located radially central of said cap, and each of said sets of switches being located radially exterior of said pin.

6. A dual function button, comprising:

a substrate;

a cap mounted to said substrate in spaced opposed relation and movable toward and away from said substrate upon application of pressure to said cap;

first switch means for completing a first circuit upon application of a first pressure to said cap, wherein said first switch includes:

a film mounted in spaced relation to said cap when said cap is subjected to a pressure below said first pressure;

a first pair of traces mounted on said film in opposed relation to said cap; and a conductive pellet mounted to said cap in opposed relation to said first traces, said pellet being placed such that said pellet contacts both said first traces upon application of at least said first pressure to said cap; and second switch means for completing a second circuit upon application of a second pressure to said cap, said second pressure being greater than said first pressure, wherein said second switch includes:

a pair of second traces mounted on said substrate in opposed relation to said cap;

a resiliently deformable dome mounted upon said substrate, intermediate said film and said substrate and in spaced relation to said cap when said cap is subjected to pressure below said first pressure in an undeformed condition said dome not contacting both said traces but in a deformed condition said dome contacting both said traces, said dome being positioned and sized such that said dome is in said undeformed condition when said cap is subjected to a pressure below said second pressure, but said dome is in said deformed condition when said cap is subjected to a pressure of at least said second pressure.

7. A button as in claim 6, wherein said cap includes a resilient peripheral intermediate section forming a column extending toward and supported by said substrate, said column preventing movement of said cap upon application of pressure to said cap below said first pressure, but buckling, and therefore permitting said movement of said cap, upon application of pressure to said cap of at least said first pressure.

8. A button as in claim 6, further comprising a plurality of sets of said first and said second switch means, each associated with said cap.

9. A button as in claim 8, wherein said cap includes a rocker pin mounted thereon and projecting toward a free end in opposed relation to said substrate, said pin being located radially central of said cap, and each of said sets of switch means being located radially exterior of said pin.

10. A dual function button, comprising:

a substrate;

a cap mounted to said substrate and movable from a rest position to first position upon application of a first pressure, and further movable to a second position, movement of said cap between said positions being generally normal to said substrate;

a first switch mounted intermediate said cap and said substrate, said first switch being open when said cap is in said rest position and being closed when said cap is in said first position, said first switch including;

a film mounted in spaced relation to said cap when said cap is in said rest position and in abutting relation to said cap when said cap is in said first position;

a first pair of traces mounted on said film in opposed relation to said cap, said first pair of traces forming a portion of a first circuit; and a conductive pellet mounted to said cap in opposed relation to said first traces, said pellet being placed such that said pellet contacts both said first traces when said cap is in said first position; and a second switch mounted intermediate said first switch and said substrate, said second switch being open when said cap is in said rest and said first positions, and being closed when said cap is in said second position, said second switch including;

a pair of second traces mounted on said substrate in opposed relation to said cap, said second pair of traces forming a portion of a second circuit;

a resiliently deformable dome mounted upon said substrate, intermediate said film and said substrate and in opposed relation to said cap, in a position such that in an undeformed condition said dome does not contact both said second traces but in a deformed condition said dome contacts both said second traces, said dome being positioned and sized such that said dome is in said undeformed condition when said cap is in said rest and said first positions, but said dome is in said deformed condition when said cap is in said second position, deformation of said cap requiring application of a second pressure to said cap, said second pressure being greater than said first pressure.

11. A button as in claim 10, wherein said cap includes a resilient peripheral intermediate section forming a column extending toward and supported by said substrate, said column preventing movement of said cap upon application of pressure to said cap below said first pressure, but buckling, and therefore permitting said movement of said cap, upon application of pressure to said cap of at least said first pressure.

12. A button as in claim 11, further including:

a resilient main body mounted upon said substrate, said intermediate section extending monolithically between said main body and said cap;

a plurality of sets of said first and second switches, each associated with a common one of said caps, said first switches each sharing a common said film;

said cap further including a rocker pin mounted thereon and projecting toward a free end in opposed relation to said substrate, said pin being located radially central of said cap, and each of said sets of switch means being located radially exterior of said pin, said pin extending through an aperture in said film, a distance between said free end of said pin and said substrate being less than a distance between said pellets and said first traces.

* * * * *